US008905056B2

(12) United States Patent
Kendrick

(10) Patent No.: US 8,905,056 B2
(45) Date of Patent: Dec. 9, 2014

(54) SYSTEMS AND METHODS FOR ROUTING PRESSURIZED FLUID

(75) Inventor: William Donald Kendrick, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 531 days.

(21) Appl. No.: 12/882,493

(22) Filed: Sep. 15, 2010

(65) Prior Publication Data

US 2012/0060929 A1 Mar. 15, 2012

(51) Int. Cl.

| | |
|---|---|
| ***F17D 3/00*** | (2006.01) |
| ***F04D 13/16*** | (2006.01) |
| ***F04D 29/42*** | (2006.01) |
| ***E21B 43/26*** | (2006.01) |
| ***E21B 21/06*** | (2006.01) |
| ***F04D 29/52*** | (2006.01) |
| ***F04D 13/12*** | (2006.01) |
| ***F04D 13/14*** | (2006.01) |

(52) U.S. Cl.

CPC ..... *F04D 29/426* (2013.01); *F04D 13/16* (2013.01); *E21B 43/26* (2013.01); *E21B 21/062* (2013.01); *F04D 29/528* (2013.01); *F04D 13/12* (2013.01); *F04D 13/14* (2013.01)

USPC ..... 137/15.01; 137/615; 166/308.2

(58) Field of Classification Search

USPC ..... 137/615, 899, 565.01, 899.3, 899.4, 137/579, 15.01; 166/177.5, 308.2; 212/300, 212/301, 306; 141/67, 236, 244, 387, 388; 210/241; 248/647; 406/43

See application file for complete search history.

(56) References Cited

U.S. PATENT DOCUMENTS

| | | | | |
|---|---|---|---|---|
| 1,124,604 | A * | 1/1915 | Gailor | 137/899.4 |
| 1,388,511 | A | 8/1921 | Cartwright | |
| 1,452,779 | A * | 4/1923 | Barry | 137/615 |
| 2,134,453 | A | 10/1938 | Müller et al. | |
| 3,028,010 | A * | 4/1962 | Headrick | 137/236.1 |
| 3,106,071 | A | 10/1963 | Green et al. | |
| 3,421,245 | A | 1/1969 | Lerch | |
| 4,253,503 | A * | 3/1981 | Gunn | 141/59 |
| 4,570,673 | A * | 2/1986 | Kendrick et al. | 137/615 |
| 4,603,887 | A | 8/1986 | Mayfield et al. | |
| 4,993,463 | A * | 2/1991 | von Meyerinck et al. | 141/279 |
| 5,195,564 | A * | 3/1993 | Spalding | 141/59 |
| 5,392,814 | A * | 2/1995 | Brotcke et al. | 137/565.01 |
| 5,551,842 | A * | 9/1996 | Schmid et al. | 417/203 |
| 5,964,295 | A * | 10/1999 | Brown et al. | 166/308.2 |
| 6,306,800 | B1 * | 10/2001 | Samuel et al. | 166/308.2 |

(Continued)

OTHER PUBLICATIONS

PCT Search Report and Written Opinion for International Application No. PCT/GB2011/001335, dated Dec. 27, 2011.

(Continued)

*Primary Examiner* — Craig Schneider
*Assistant Examiner* — Craig J Price
(74) *Attorney, Agent, or Firm* — John W. Wustenberg; Baker Botts L.L.P.

(57) ABSTRACT

A manifold system for routing pressurized fluid from a fluid source is disclosed. The manifold system includes a manifold assembly. The manifold assembly includes a frame, an intake section coupled to the frame, and an articulating arm coupled to the intake section. The intake section is configured to route pressurized fluid to the articulating arm. The articulating arm is configured to route pressurized fluid away from the intake section.

12 Claims, 7 Drawing Sheets

(56) References Cited

U.S. PATENT DOCUMENTS

| | | | | |
|---|---|---|---|---|
| 6,412,561 | B1 * | 7/2002 | Brown et al. | 166/308.2 |
| 6,701,980 | B2 * | 3/2004 | Rothrock | 137/615 |
| 6,968,868 | B2 * | 11/2005 | Hart et al. | 141/59 |
| 7,635,254 | B2 * | 12/2009 | Kunz et al. | 417/234 |
| 7,694,731 | B2 * | 4/2010 | Decker | 166/177.5 |
| 8,066,073 | B2 * | 11/2011 | Hutchins et al. | 166/308.3 |
| 8,069,710 | B2 * | 12/2011 | Dodd et al. | 73/114.54 |
| 8,302,639 | B2 * | 11/2012 | Jorgensen | 141/198 |
| 2003/0221747 | A1 * | 12/2003 | Rothrock | 141/388 |
| 2006/0204372 | A1 | 9/2006 | Scampoli | |
| 2007/0125543 | A1 | 6/2007 | McNeel et al. | |
| 2007/0125544 | A1 | 6/2007 | Robinson et al. | |
| 2008/0029267 | A1 | 2/2008 | Shampine et al. | |
| 2010/0193057 | A1 * | 8/2010 | Garner et al. | 137/615 |
| 2010/0224256 | A1 * | 9/2010 | Tseng et al. | 137/2 |

OTHER PUBLICATIONS

FMC Technologies, Articulating Frac Arm (Patent Pending), Increased Efficiency and Safety in Frac Applications, 2009.
Weir SPM, Safety Iron® Manifold Trailer, Jan. 2009.
Weir SPM, Safety Iron™ Manifold Trailer, Sep. 2008.

* cited by examiner

SYSTEMS AND METHODS FOR ROUTING PRESSURIZED FLUID

BACKGROUND

The present disclosure relates generally to well operations and, more particularly, to systems and methods for routing pressurized fluid.

In the production of oil and gas in the field, stimulation and treatment processes often involve mobile equipment that is set up and put in place at a work site. A large arrangement of various vehicles and equipment is typically required for well operations. The movement of equipment and personnel for assembly and disassembly can involve complex logistics. One aspect of well treatment operations typically involves the setup of one or more arrays of pumping modules. Pumping modules can be hauled to the work site by truck, and pinned, bolted or otherwise located together on the ground.

Pumping modules are often operatively connected to a manifold system, which may be a manifold trailer. The manifold system may be used at a relatively central location where stimulation fluid is manufactured and pressurized and may interface with a blending module. The connections between the manifold system and the other units typically involve an elaborate arrangement of tubular connections. The assembly and subsequent disassembly of the equipment for numerous pumping modules is time-consuming and highly labor-intensive. Moreover, there are inherent risks with each connection that is made and broken, including but not limited to hammer strike, tripping, back strain, pinch points, etc. It is therefore desirable to minimize health, safety and environmental risks associated with rigging up, rigging down, and operating multiple pieces of manifold equipment and connections. It is also desirable to decrease the amount of time required to rig up and rig down manifold equipment from a pumping module to a manifold system. Therefore, there is a need for systems and methods that improve the safety, ease, and efficiency of connections between blending equipment and wellheads.

SUMMARY

The present disclosure relates generally to well operations and, more particularly, to systems and methods for routing pressurized fluid.

In one aspect, a manifold system for routing pressurized fluid from a fluid source is disclosed. The manifold system includes a manifold assembly. The manifold assembly includes a frame, an intake section coupled to the frame, and an articulating arm coupled to the intake section. The intake section is configured to route pressurized fluid to the articulating arm. The articulating arm is configured to route pressurized fluid away from the intake section.

In another aspect, a pre-assembled piping system for routing pressurized fluid from a fluid source is disclosed. The pre-assembled piping system includes an inlet for receiving fluid and an articulating arm in fluid communication with the inlet. The articulating arm is configured to direct fluid having a first pressure. The pre-assembled piping system also includes a second articulating arm proximate to the articulating arm and configured to receive pressurized fluid. The pressurized fluid has a second pressure greater than the first pressure. The pre-assembled piping system also includes a discharge line in fluid communication with the second articulating arm.

In yet another aspect, a method of routing pressurized fluid from a fluid source is disclosed. The method includes providing a manifold assembly. The manifold assembly includes a frame, an intake section coupled to the frame, and an articulating arm coupled to the intake section. The intake section is configured to route pressurized fluid to the articulating arm. The articulating arm is configured to route pressurized fluid away from the intake section. The method further includes fluidically coupling the intake section to a fluid source, fluidically coupling the articulating arm to a pump, and supplying the pump with fluid from the fluid source via the intake section and the articulating arm.

The features and advantages of the present disclosure will be readily apparent to those skilled in the art. While numerous changes may be made by those skilled in the art, such changes are within the spirit of the invention.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features.

DESCRIPTION

The present disclosure relates generally to well operations and, more particularly, to systems and methods for routing pressurized fluid.

Illustrative embodiments of the present disclosure are described in detail herein. In the interest of clarity, not all features of an actual implementation are described in this specification. It will of course be appreciated that in the development of any such actual embodiment, numerous implementation-specific decisions must be made to achieve developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure.

Figure 1:
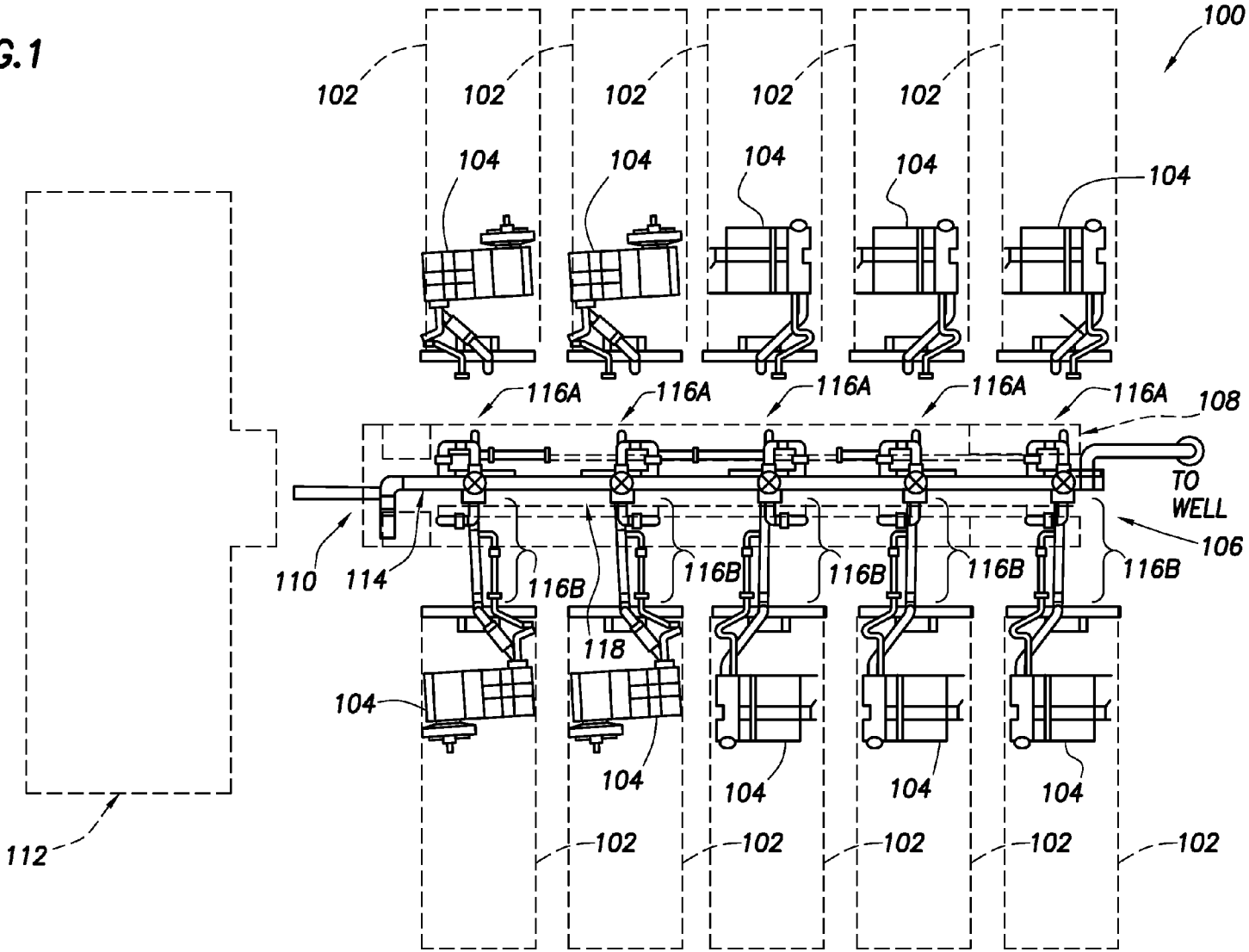
FIG. 1 illustrates a schematic plan view of one example pumping system with a manifold system, in accordance with certain embodiments of the present disclosure.

FIG. 1 illustrates a schematic plan view of one example pumping system 100 in accordance with certain embodiments of the present disclosure. The pumping system 100 may be configured for performing a well treatment operation, such as an hydraulic fracturing or stimulating operation. One or more pumping modules 102 may be employed to displace one or more volumes of fluid for an oilfield operation. As depicted, the pumping system 100 may include ten pumping modules 102 for fracturing operations. The pumping modules 102 may include positive displacement pumps 104, such as plunger pumps, or another type of pump, as would be understood by one of ordinary skill in the art. In certain embodiments, the pumping modules 102 may include pumps of a multiplex type, such as triplex, quintuplex, or another type of multiplex pump. In certain embodiments, the pumping modules 102 may not all be of the same type. Although ten pumping modules are illustrated in FIG. 1, it should be understood that a different number of pumping modules may be utilized, as desired for various pumping situations. Over the course of an operation, the number of pumping modules in service may be changed depending on the specifics of the operation as, for example, when a pumping unit is brought off-line.

The pumping modules 102 may be coupled to a manifold system 106, which may be operable to accept pressurized stimulating fluid, fracturing fluid, or other well treatment fluid. The manifold system 106 may be deployed on a mobile manifold trailer 108 (an arrangement which is sometimes referenced in field operations as a missile or missile trailer) adapted to be moved by a motorized vehicle (not shown). In the alternative, the manifold system 106 may be self-propelled. The manifold system 106 may be used at a central location where the fluid is prepared and pressurized.

The manifold system 106 may include a blending unit interface 110, which may be configured to receive fluid from one or more blending units 112. The blending unit 112 may be connected to a chemical storage system, a proppant storage system, and a water source, and may prepare a fracturing fluid, with proppant and chemical additives or modifiers, by mixing and blending fluids and chemicals according to the needs of a well formation. In one embodiment, the mixing apparatus may be a modified Halliburton Growler mixer modified to blend proppant and chemical additives to the base fluid without destroying the base fluid properties but still providing ample energy for the blending of proppant into a near fully hydrated fracturing fluid.

Once prepared by the blending unit 112, the fracturing fluid may be pumped at relatively low pressure (e.g., less than about 112 psi) from the blending unit 112 to the manifold system 106 via the blending unit interface 110. The blending unit interface 110 may be coupled to one or more low-pressure main lines 114 that extend along a length of the manifold system 106 and are in turn coupled to pump interfaces 116A and 116B (collectively referenced by numeral 116). Each pump interface 116 may include a low-pressure articulating arm configured for connecting to a pump 104. Each pump interface 116 may further include a high-pressure articulating arm configured for connecting from a pump 104 to one or more high-pressure main lines 118 that extend along a length of the manifold system 106. As depicted, the pump interfaces 116A are in retracted positions, whereas the pump interfaces 116B extend toward and are coupled to pumps 104.

Each pump interface 116 may include a swivel joint assembly. A swivel joint assembly may allow for adjustable right/left orientations of the pump interfaces 116. As depicted, pump interfaces 116B include various right and left orientation that may facilitate arrangement of, and connection to, the pumping modules 102 and pumps 104. Additionally, the swivel joint assemblies of pump interfaces 116 may allow for adjustable extension and refraction between the manifold system 106 and the pumping modules 102 and pumps 104. The swivel joint assemblies may be adjustable to accommodate equipment connections in spite of parking misalignment to the left or right, for example. The swivel joint assemblies may be adjustable to accommodate variations in elevations and angles of the equipment. Further, the swivel joint assemblies of pump interfaces 116 may accommodate movement of the pumping modules 102 and/or pumps 104 that may occur during operations. Further still, the swivel joint assemblies of pump interfaces 116 may reduce the weight that workers would need to lift during set-up and take-down, thereby providing the benefit of ease of installation. Because the weight of extension arms of the pump interfaces 116 may be supported at least in part, larger diameter lines may be used with the low-pressure lines, for example. The low-pressure line of each pump interface 116 may be adjustable to provide a downward slope from the manifold system 106 that may avoid the problems associated with sand accumulation. The details of the pump interfaces 116 will be described in further detail herein.

The one or more low-pressure main lines 114 may channel fluid to one or more pumps 104 through the low-pressure articulating arms. After receiving the fluid, a pump 104 may discharge the fluid at a relatively high pressure back to the high-pressure main line 118 through a high-pressure articulating arm. The fluid may then be directed toward a well bore. A line from the manifold system 106 may connect directly to a well head, or it may be connect to intervening equipment such as a pump truck or another manifold system, depending on the particular implementation.

Figure 2:
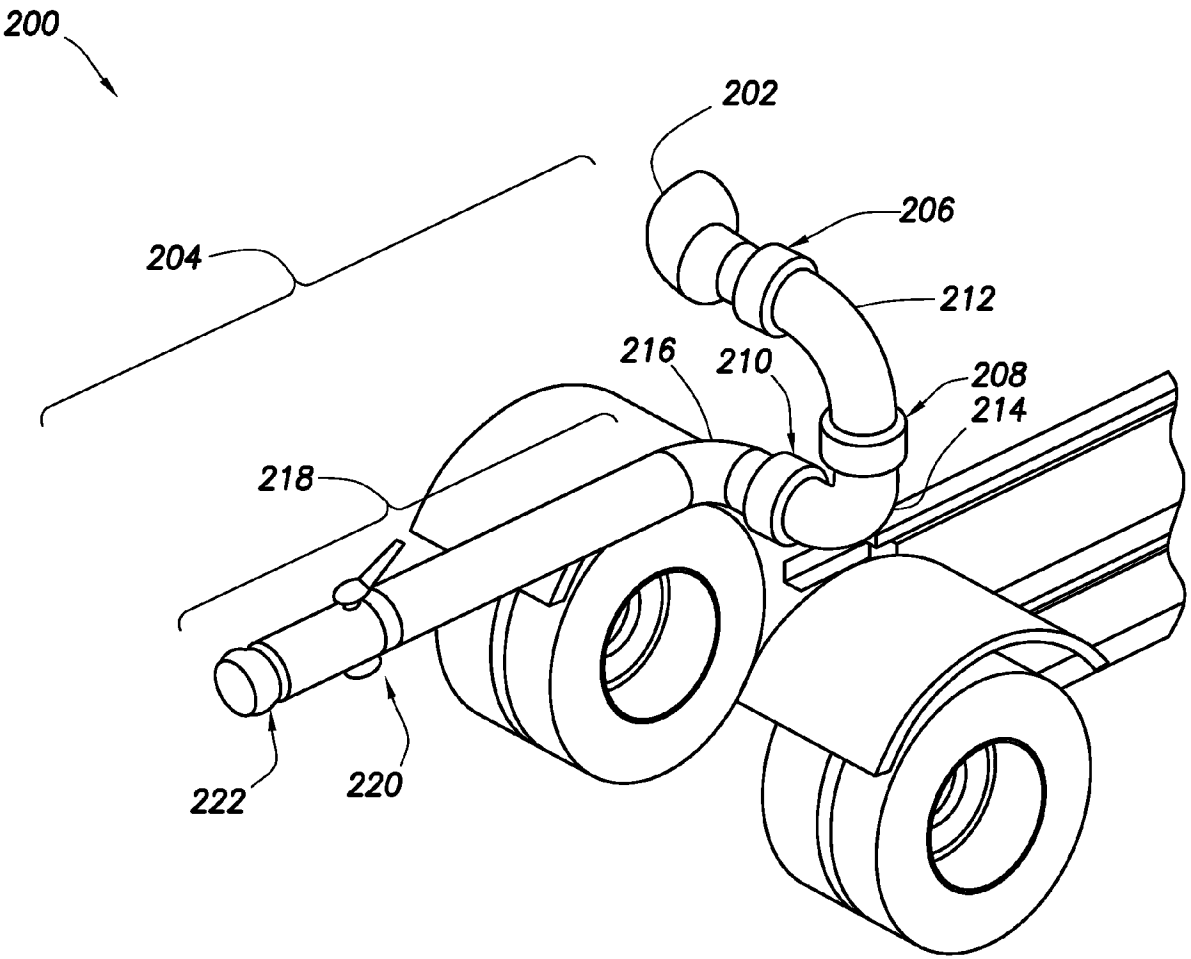
FIG. 2 illustrates a schematic perspective view of one example blender interface of a manifold system, in accordance with certain embodiments of the present disclosure.

FIG. 2 is a schematic perspective view of blender interface 200, which may correspond to the blending unit interface 110 of the manifold system 106. For the sake of clarity, certain elements of manifold system 106 are omitted. The blender interface 200 may be coupled to the low-pressure main line 114 (not shown) via a curved connection 202. The blender interface 200 may include an articulating arm 204 with three points of articulation. The articulating arm 204 may include swivel joints 206, 208 and 210. A curved connection 212 may be coupled to the curved connection 202 via the swivel joint 206, which may be configured to allow for rotational positioning of the connection 212 relative to the connection 202. A curved connection 214 may be coupled to the curved connection 212 via the swivel joint 208, which may be configured to allow for rotational positioning of the connection 214 relative to the connection 212. A curved connection 216 and extension 218 may be coupled to the curved connection 214 via the swivel joint 210, which may be configured to allow for rotational positioning of the connection 214 and extension 218 relative to the connection 214. The extension 218 may include a coupling 220 that may be a lockable coupling, which may be suitable for quick connection and disconnection. The coupling 220 additionally may be a ball and socket type of coupling such that end section 222 may be allowed a range of socket flexibility with respect to the rest of the extension 218.

Figure 3:
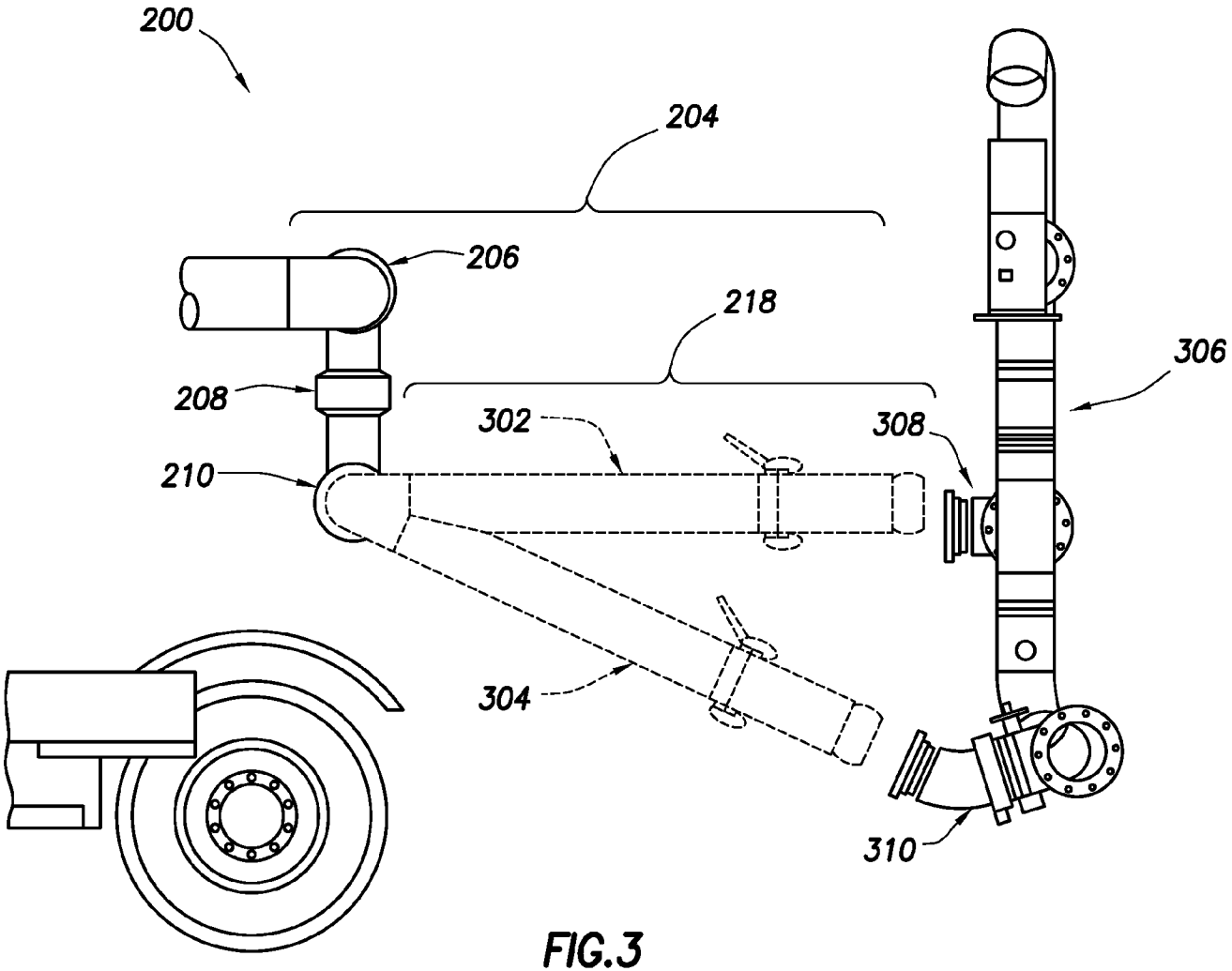
FIG. 3 illustrates a schematic side view of one example blender interface of a manifold system, in accordance with certain embodiments of the present disclosure.

FIG. 3 is a schematic side view of blender interface 200 illustrating one example adjustment allowed by the articulating arm 204. As depicted, the extension 218 may be adjusted about swivel joint 210 between two example extension positions 302 and 304. The positions 302 and 304, for example, may correspond to a blender outlet, which may be in a variety of locations depending on the implementation. A blender manifold 306 having two example blender outlet positions 308 and 310 is depicted.

It should be understood that the articulating arm 204 may be adjustable so that a wider range of adjustment than that shown in FIG. 3 is contemplated. It should be further understood that FIG. 3 merely illustrates certain degrees of freedom about only one point of articulation (viz., that provided by swivel joint 210), whereas the swivel joints 206 and 208 provide additional points of articulation and corresponding degrees of freedom not depicted.

Figure 4:
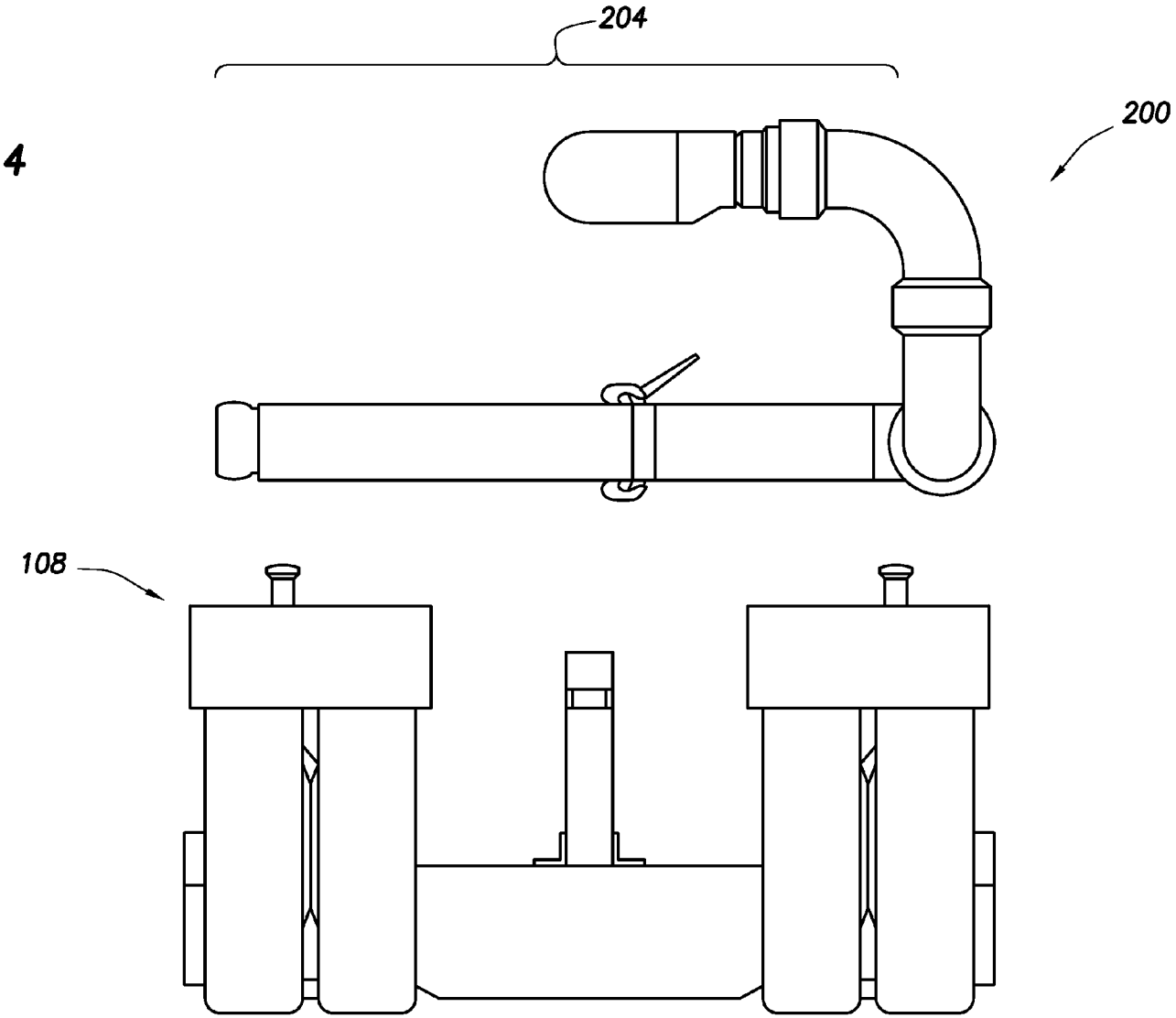
FIG. 4 illustrates a partial schematic end view of one example blender interface of a manifold system, in accordance with certain embodiments of the present disclosure.

FIG. 4 is a partial schematic of blender interface 200 as viewed from the end of the manifold system 106. As depicted, the articulating arm 204 may be retractable with respect to the mobile manifold trailer 108. In such a retracted position, the articulating arm 204 may be suitably positioned for transport and/or storage.

Figure 5:
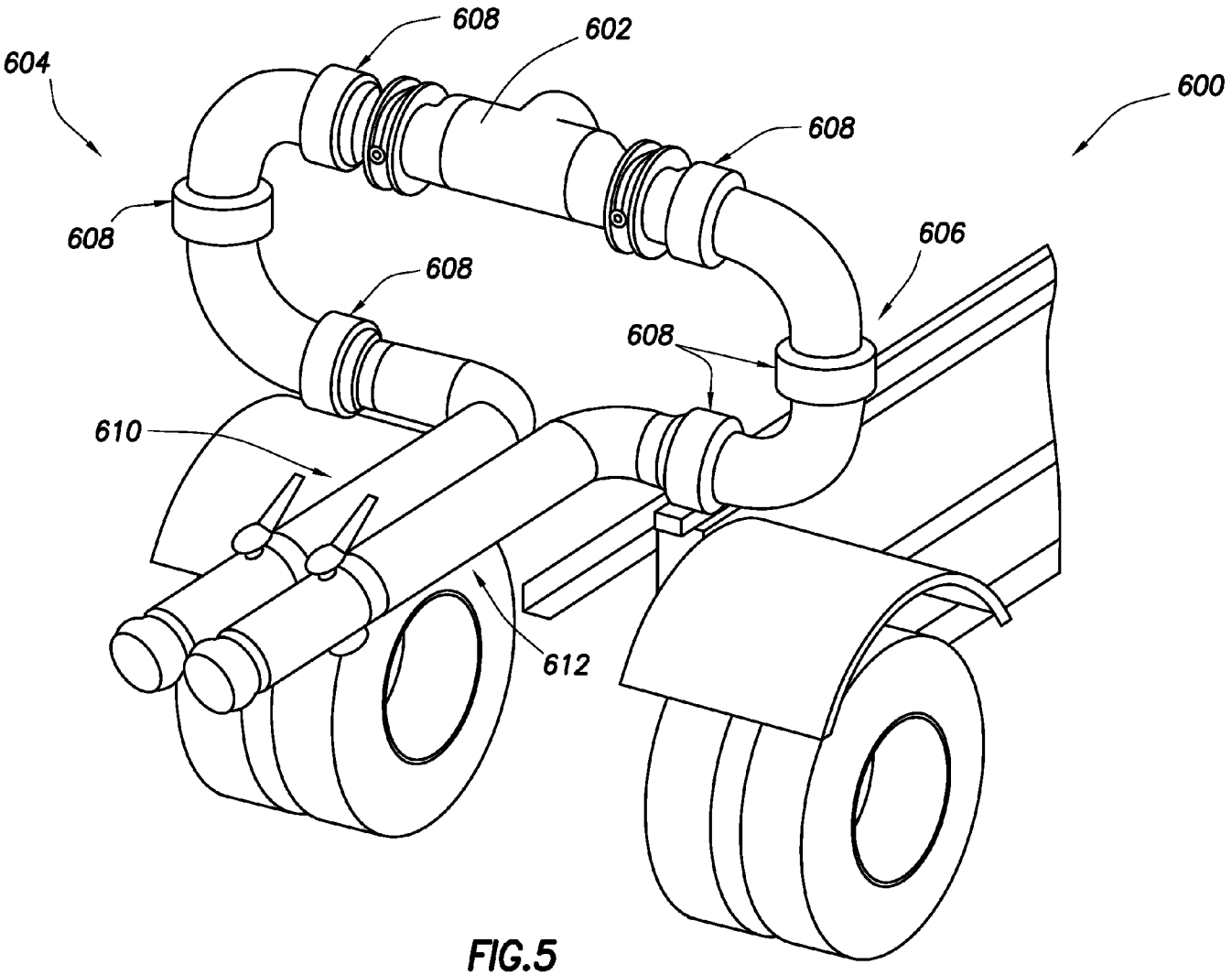
FIG. 5 illustrates a schematic perspective view of one example dual blender interface of a manifold system, in accordance with certain embodiments of the present disclosure.

FIG. 5 is a schematic perspective view of a dual blender interface 600 in accordance with certain embodiments. The two fluid lines provided by the dual blender interface 600 may facilitate higher pumping rates. In alternative embodiments not shown, a blender interface may be configured to accommodate any suitable number of fluid lines.

The blender interface 600 may be coupled to the low-pressure main line 114 (not shown) via a tee joint 602. The tee joint 602 may connect articulating arms 604 and 606. Similar to the articulating arm 204, each articulating arm 604 and 606 may have three points of articulation provided by swivel joints 608. Each swivel joint 608 may be configured to allow for rotational positioning of its adjoining members. Accordingly, the articulating arms 604 and 606 may have a significant range of freedom for adjustment. The articulating arms 604 and 606 may respectively include extensions 610 and 612. Each extension 610 and 612 may include a coupling, such as a lockable coupling, which may be suitable for quick connection and disconnection and additionally may be a ball and socket type that allows a range of socket flexibility.

Figure 6:
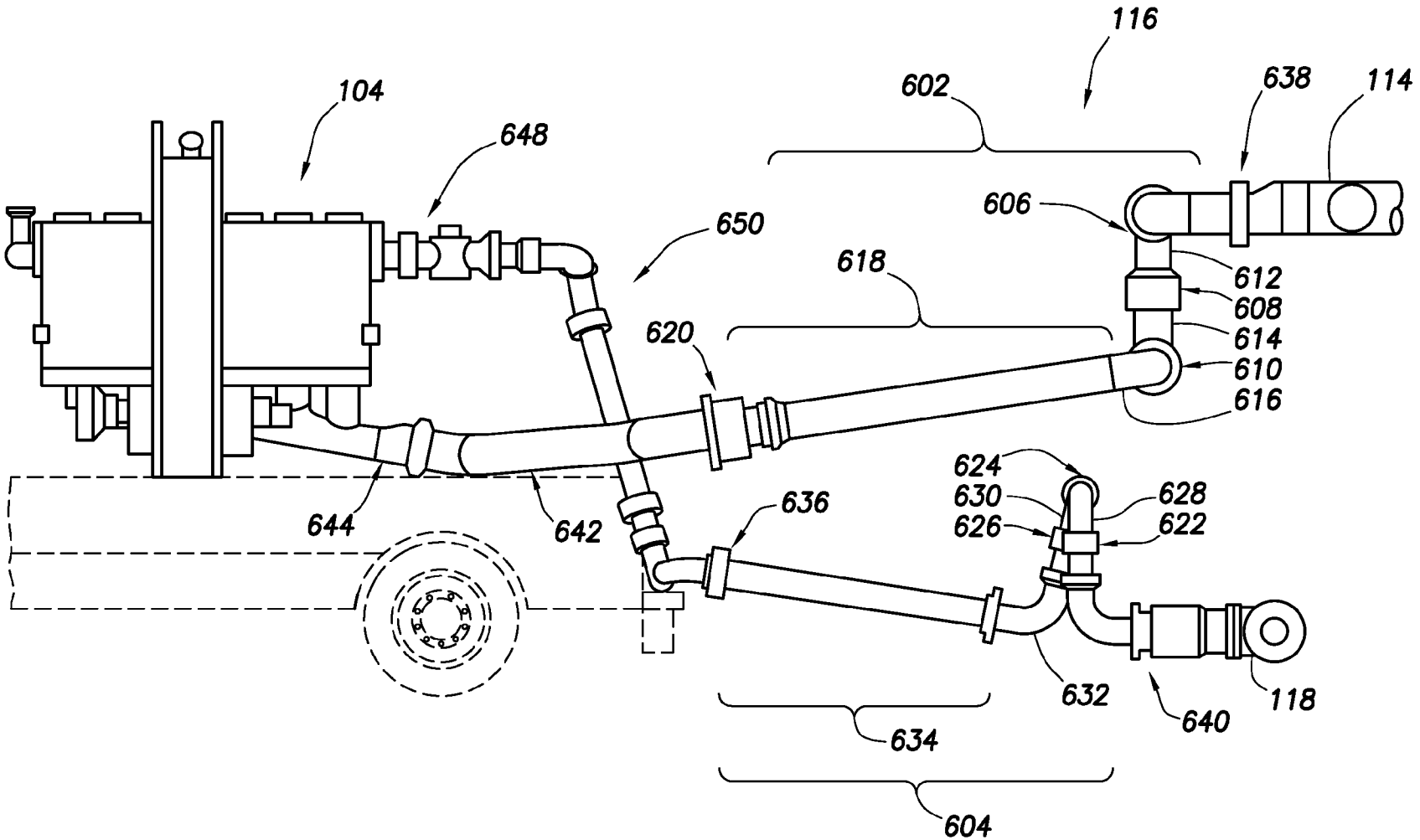
FIG. 6 illustrates a partial schematic side view of one example pump interface of a manifold system, in accordance with certain embodiments of the present disclosure.
Figure 7:
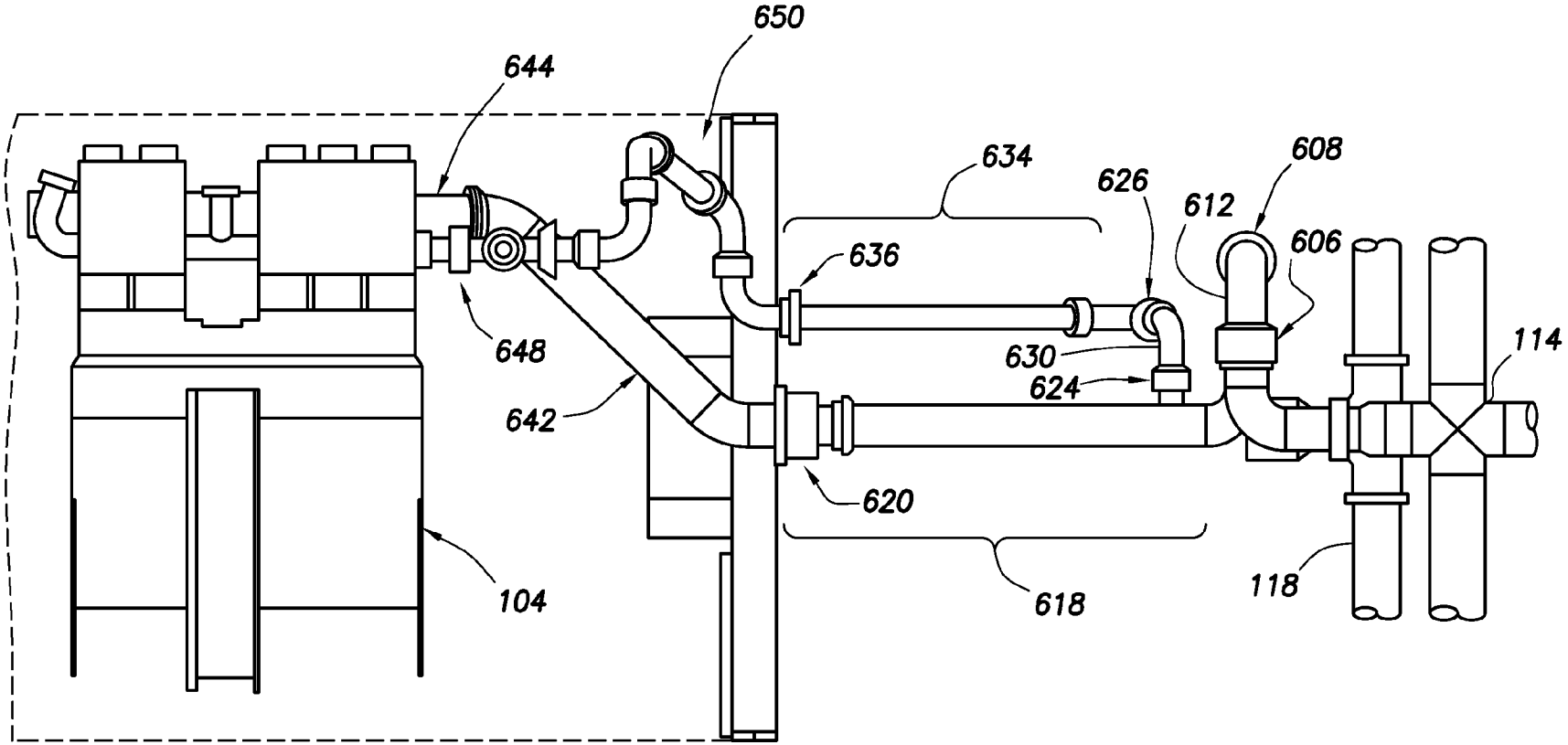
FIG. 7 illustrates a partial schematic top view of one example pump interface of a manifold system, in accordance with certain embodiments of the present disclosure.

FIG. 6 is a partial schematic side view of a pump interface 116 of the manifold system 106. FIG. 7 is a partial schematic top view. The pump interface 116 may include a low-pressure arm 602 and a high-pressure arm 604. The low-pressure arm 602 may be coupled to the low-pressure main line 114. As depicted in FIG. 7, the low-pressure main line 114 may utilize a four-way junction for coupling to the low-pressure arm 602. The low-pressure arm 602 may include three points of articulation by way of swivel joints 606, 608 and 610. Each swivel joint may be configured to allow for rotational positioning of its adjoining members 612, 614 and/or 616. In certain embodiments, a valve (not shown), such as a butterfly valve, may be provided at one or more locations, such as position 638 and/or a position corresponding to the high-pressure arm 604, to control fluid flow. An extension 618 may be coupled to the member 616 and may include an end connection 620. The end connection 620 may be of a ball joint/socket type designed to provide a range of angular flexibility, or a rotatable section with a slight bend, or any other connection type, as desired.

The high-pressure arm 604 may be fluidically coupled to the high-pressure main line 118 and may include three points of articulation by way of swivel joints 622, 624 and 626. Each swivel joint may be configured to allow for rotational positioning of its adjoining members 628, 630 and/or 632. In certain embodiments, an additional point of articulation may be provided, for example, employing a swivel joint at position 640. An extension 634 may be coupled to member 632 and may include an end connection 636. In certain embodiments, the end connection 636 may be of a hammer union or "quick connector," for example.

Referring again to the low-pressure arm 602, the end connection 620 may be configured to receive pump header connection 642. In certain embodiments, the end connection 620 may be configured as a ball/socket joint. A pump 104 with a header inlet 644 may be connected to the pump header connection 642, for example, via one or more hammer unions and/or dog-leg connections. The pump header connection 642 may be arranged to slope downward from the end connection 620 and toward the header inlet 644. The pump header connection 642 may be configured to direct fluid toward the centerline of the pumping unit and/or toward an elevation that is approximately common with other equipment. Such features may facilitate the parking of multiple pumping units in generally symmetrical and/or evenly spaced manner. A downward slope would allow gravity to aid the movement of fluid and, in some cases, other elements inside the low-pressure line such as sand. The suction line provided by the pump header connection 642 and the extension 618 may be preferable to a conventional hose connection. A hose connection would result in a sagging profile that would allow for the undesirable accumulation of particulate matter, such as sand, in the sagging section of the hose. Use of the pump header connection 642 and the extension 618 may eliminate or mitigate that problem.

The pump 104 may be a part of a pumping module 102 and may be mounted on a mobile trailer. One of ordinary skill in the art would understand that other elements, not shown in FIG. 6, are typically associated with a pumping module that would include a pump such as the pump 104. For the sake of clarity, such other elements are omitted from FIG. 6.

The pump 104 may discharge through a discharge outlet 648 coupled to a high-pressure discharge connection 650, for example, via one or more hammer unions, "T" connections, and/or dog-leg connections. The high-pressure discharge connection 650 may be arranged to have a decline away from the discharge outlet 648 for positioning. The high-pressure discharge connection 650 may be coupled to the high-pressure arm 604 via end connection 636, which may be configured to receive the high-pressure discharge connection 650.

As noted in reference to FIG. 1, each pump interface 116 may be retractable. The low-pressure arm 602 and high-pressure arm 604 may fold in toward the manifold system 106 to a position suitable for storage and/or transport with the system. Because the articulating arms 602, 604 are structurally supported by the manifold system 106, the force and labor required to move and position the arms are minimized.

The low-pressure lines throughout the manifold system 106 may utilize larger lines than a conventional system. For example, six-inch lines may be used. The larger lines allow for less constant-flow pressure drop, less acceleration-head pressure drop, and the elimination of the need for multiple hose connections. Minimizing the pressure drop throughout the low-pressure part of the system 106 may improve suction characteristics of the pumps 104. Consequently, the possibility of cavitation in those pumps may be reduced, pump life may be increased, and operation costs may be reduced. Elimination of hose connections consequently eliminates the need for transporting the connections to/from the worksite and for carrying and connecting them. It allows for the elimination of low spots in sagging hoses where sand is apt to collect under low-velocity conditions.

The manifold system 106 may be configured to connect directly to a well head, or it may be connect to intervening equipment such as a pump truck or another manifold system, depending on the particular implementation. As depicted in FIG. 1, certain embodiments of the manifold system 106 may be configured for a single-line interface to the well head and/or intervening equipment. The single-line interface may be capable of delivering fluid at similar rates and pressures as would have previously required four 4" lines or six 3" lines. In some embodiments, it may be advantageous to configure the manifold system 106 with a multiple-line interface. For example, additional lines may be useful to provide higher fluid pumping rates, separated fluid flows, simultaneous bi-directional fluid flow, or system redundancy. One of ordinary skill in the art with the benefit of this disclosure would be able to determine the optimum number of lines required for a given set of operational conditions.

Certain embodiments of this disclosure help to minimize health, safety and environmental risks associated with rigging up, rigging down, and operating multiple pieces of manifold equipment and connections. For example, minimizing health and safety risks may be achieved by reducing lifting, carrying, and hammering during rig-up and rig-down. The number of connections typically required for well treatment operations, such as fracturing or stimulation operations, may be reduced. This reduces the inherent risks with each connection that is made and broken, including but not limited to hammer strike, tripping, back strain, pinch points, etc. Moreover, minimizing environmental hazards may be achieved by reducing potential leak points in the connections of the system. Further, certain embodiments allow the assembly and subsequent disassembly of the equipment for numerous pumping modules to be more efficient, less time-consuming, and less labor-intensive. Each of these benefits contributes to a reduction in operating expenses.

Conventional systems typically require many hoses, swivels, and straight joints, each of which requires multiple action steps for rig-up and rig-down. In addition, hammer unions are often required, adding to the difficulty. For example, each hose may require unloading, carrying, attaching a wing end, attaching a thread end, detaching the thread end, detaching the wing end, carrying, and loading. Each of the action steps is an opportunity for injury and is time-consuming. Over the course of a rig-up and rig-down of a complete system, the aggregate of the action steps results in many opportunities for injury and significant time and expense.

In contrast, certain embodiments of this disclosure provide a plug and pump manifold system that would replace the many hoses, swivels, and straight joints with low- and high-pressure lines that are pre-rigged in the manifold system and that have adequate flexibility to accommodate the variability of equipment positioning, vibration and other movement. The low- and high-pressure lines may include articulating arms configured to swing out toward the pumping modules. The low-pressure lines may utilize larger lines that reduce the total number of lines required. By utilizing a hammerless connection, the articulating arms further reduce the time requirements and the safety hazards. The articulating arms are not broken loose as part of the rig-down procedure. Relative to conventional systems, the plug and pump manifold system may reduce the number of action steps, and consequently the time requirements and opportunities for injury, by as much as 60% or more. Accordingly, the present disclosure provides for a novel rig and manifold system with advantages over conventional systems.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. The indefinite articles "a" or "an", as used in the claims, are defined herein to mean one or more than one of the element that it introduces. Also, the terms in the claims have their plain, ordinary meaning unless otherwise explicitly and clearly defined by the patentee.

What is claimed is:

1. A manifold system for routing pressurized fluid from a fluid source, the manifold system comprising:

a manifold assembly comprising:

a frame;

an intake section coupled to the frame;

a plurality of articulating arms coupled to the intake section, wherein the intake section is configured to route pressurized fluid to the plurality of articulating arms, wherein the plurality of articulating arms are in parallel fluid communication with each other, and wherein the plurality of articulating arms are configured to route pressurized fluid away from the intake section;

a plurality of pumps configured to receive pressurized fluid from the plurality of articulating arms wherein the plurality of pumps are in parallel with each other;

a plurality of discharge articulating arms proximate to the plurality of articulating arms and configured to receive pressurized fluid from a plurality of pumps, wherein the pressurized fluid has a second pressure greater than the first pressure; and a discharge line in fluid communication with the plurality of discharge articulating arms.

2. A pre-assembled piping system for routing pressurized fluid from a fluid source, the pre-assembled piping system comprising:

an inlet for receiving fluid;

a plurality of articulating arms in fluid communication with the inlet, wherein the plurality of articulating arms are configured to direct fluid having a first pressure, wherein the plurality of articulating arms are in parallel fluid communication with each other;

a plurality of pumps configured to receive fluid having a first pressure from the plurality of articulating arms, wherein the plurality of pumps are in parallel with each other;

a plurality of discharge articulating arms proximate to the plurality of articulating arms and configured to receive pressurized fluid from a plurality of pumps, wherein the pressurized fluid has a second pressure greater than the first pressure; and a discharge line in fluid communication with the plurality of discharge articulating arms.

3. The pre-assembled piping system of claim 2, further comprising:

a third articulating arm in fluid communication with the inlet.

4. The pre-assembled piping system of claim 3, wherein the third articulating arm comprises at least two points of articulation.

5. The pre-assembled piping system of claim 2, wherein the plurality of articulating arms comprises at least two points of articulation.

6. The pre-assembled piping system of claim 2, wherein the plurality of discharge articulating arms comprises at least two points of articulation.

7. The pre-assembled piping system of claim 2, wherein the pre-assembled piping system is configured as a mobile unit.

8. A method of routing pressurized fluid from a fluid source, the method comprising:

providing a manifold assembly comprising:

a frame;

an intake section coupled to the frame; and a plurality of articulating arms coupled to the intake section;

wherein the intake section is configured to route pressurized fluid to the plurality of articulating arms, wherein the plurality of articulating arms are in parallel fluid communication with each other; and wherein the plurality of articulating arms are configured to route pressurized fluid away from the intake section;

fluidically coupling the intake section to a fluid source;

fluidically coupling the plurality of articulating arms to a plurality of pumps, wherein the plurality of pumps are in parallel with each other;

supplying the plurality of pumps with fluid from the fluid source via the intake section and the plurality of articulating arms; and directing fluid discharged by the plurality of pumps toward a discharge line via a plurality of discharge articulating arms.

9. The method of claim 8, further comprising:

providing a plurality of discharge articulating arms configured to receive fluid discharged by the plurality of pumps.

10. The method of claim 9, further comprising:

providing a high pressure main line in fluid communication with the plurality of discharge articulating arms; and directing fluid discharged by the plurality of pumps to the high pressure main line via the plurality of discharge articulating arms.

11. The method of claim 8, further comprising:

providing a third articulating arm in fluid communication with the intake section and the fluid source; and routing fluid from the fluid source to the intake section via the third articulating arm.

12. The method of claim 8, wherein the manifold assembly is configured as a mobile unit.

* * * * *